US006751816B1

(12) United States Patent
Wechsler

(10) Patent No.: US 6,751,816 B1
(45) Date of Patent: Jun. 22, 2004

(54) EXERCISE MAT ENSEMBLE AND METHOD OF USE

(76) Inventor: Barbara Wechsler, 84 Pine Island Turnpike, Warwick, NY (US) 10990

( * ) Notice: Subject to any disclaimer, the term of this patent is extended or adjusted under 35 U.S.C. 154(b) by 0 days.

(21) Appl. No.: 10/417,725

(22) Filed: Apr. 17, 2003

(51) Int. Cl.[7] ..... A47G 9/06

(52) U.S. Cl. ..... 5/417; 5/420; 383/4; 383/74; 482/23

(58) Field of Search ..... 5/417, 420; 383/4, 383/74; 482/23

(56) References Cited

U.S. PATENT DOCUMENTS

| | | | | | |
|---|---|---|---|---|---|
| 1,930,942 | A | | 10/1933 | Pringle | 5/344 |
| 2,264,471 | A | | 12/1941 | Glenn | 5/344 |
| 3,262,134 | A | | 7/1966 | Bramble, Jr. | 5/344 |
| 3,774,249 | A | | 11/1973 | Ybarra et al. | 5/344 |
| 4,137,583 | A | | 2/1979 | Baldwin et al. | 5/344 |
| 4,601,076 | A | * | 7/1986 | Knobeloch | 5/420 |
| 4,738,545 | A | | 4/1988 | Westgor | 383/4 |
| 4,841,587 | A | | 6/1989 | Carter et al. | 5/419 |
| 5,099,530 | A | | 3/1992 | Scott | 5/420 |
| 5,199,120 | A | | 4/1993 | Holmes | 5/419 |
| 5,203,041 | A | | 4/1993 | Alonso | 5/420 |
| 5,291,625 | A | * | 3/1994 | Leslie | 5/420 |
| 5,720,057 | A | | 2/1998 | Duncan | 5/420 |
| 6,065,164 | A | | 5/2000 | Swanger et al. | 5/420 |
| 6,141,805 | A | | 11/2000 | Fisher-Cohen et al. | 5/420 |
| 6,663,537 | B2 | * | 12/2003 | McCoy | 5/417 |

FOREIGN PATENT DOCUMENTS

| | | | | |
|---|---|---|---|---|
| CA | 2366748 | * | 7/2003 | |
| GB | 2010178 | * | 6/1979 | 5/420 |

OTHER PUBLICATIONS

Advertisement (Internet) matsmatsmats.com 3 sheets, Oct. 16, 2002.

Advertisement (Internet) bluelotusyoga.net/bags 1 sheet, Jan. 7, 2003.

* cited by examiner

*Primary Examiner*—Jong-Suk (James) Lee
(74) *Attorney, Agent, or Firm*—Sandra M. Kotin

(57) ABSTRACT

An exercise mat ensemble for use in exercise disciplines such as yoga that involve floor exercises and positions. A vinyl padded sticky mat is covered with a sheet of washable absorbent fabric that overlays the sticky mat on all four sides. The fabric sheet may be extended at one transverse end with sufficient fabric that when folded over more than once it forms a cushion to aid in certain exercises and positions. When the fabric sheet is placed on top of the mat and the two are rolled together the fabric extension encloses the mat within the roll. The extension may also be stitched to form an envelope or stitched on each side to form channels into which drawstrings are placed, both capable of forming a case around the rolled mat and fabric sheet. A strap may be added to the ensemble to assist in certain exercises and positions and also to be incorporated into the rolled mat and fabric sheet for use as a carrying strap. The fabric extension may also be separate from the main fabric sheet to increase the number of fold possibilities, to provide added assistance for specific exercises and positions, and to serve as a meditation blanket. A sheath may be used to cushion the strap for ease of carrying.

42 Claims, 8 Drawing Sheets

56
54
52
55
56
54
53
57

50
54
54
51
57
52

55
54
57
54

50
52
51
53
53
55

54
58

52
51

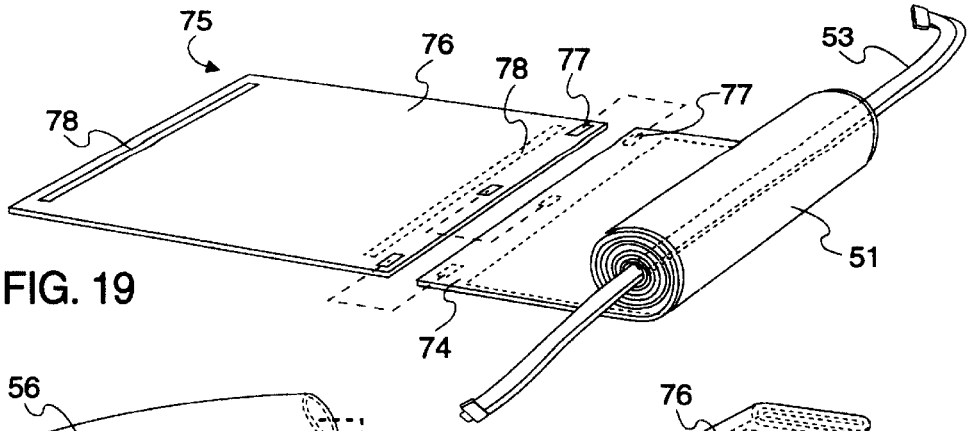
FIG. 19
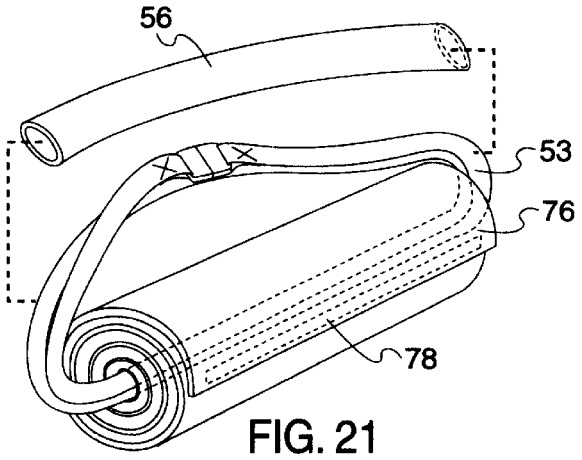
FIG. 21
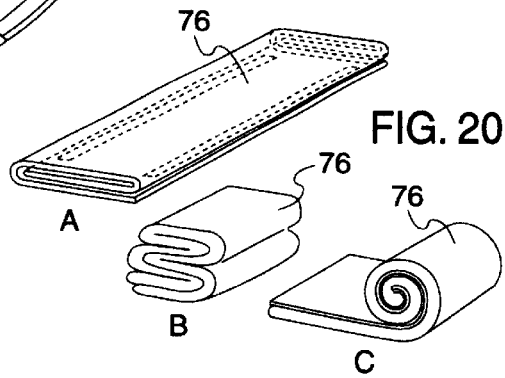
FIG. 20
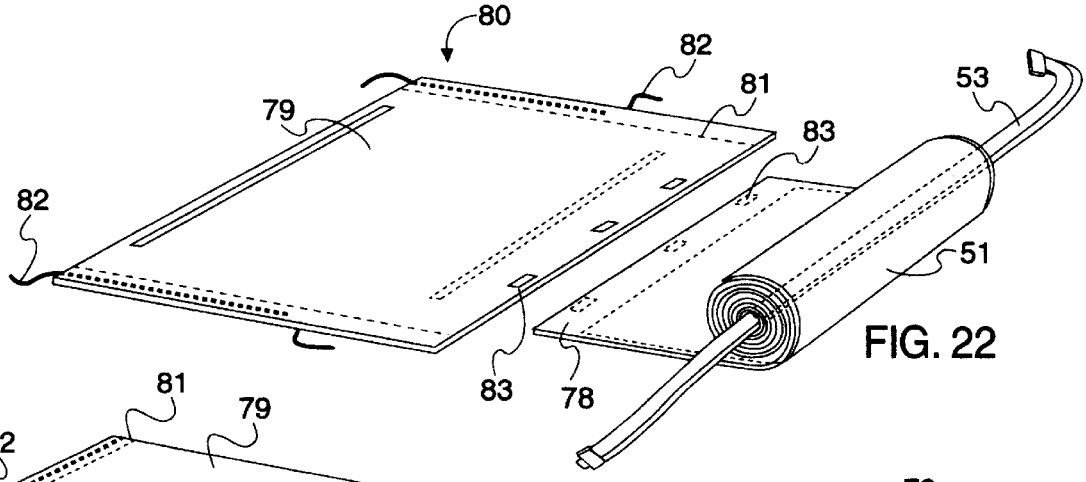
FIG. 22
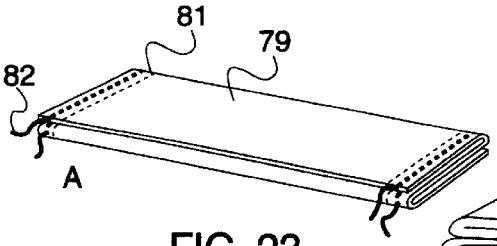
FIG. 23
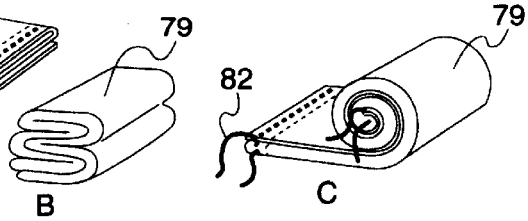

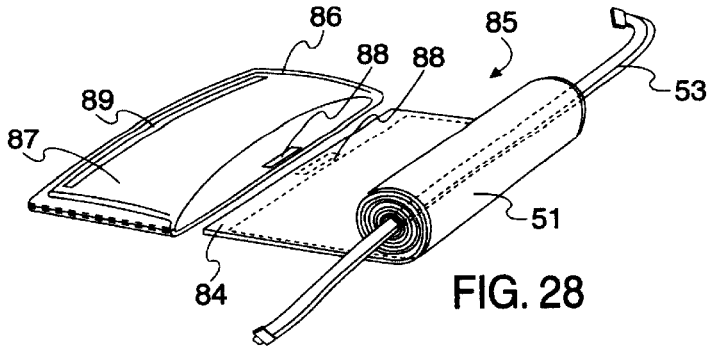
FIG. 28
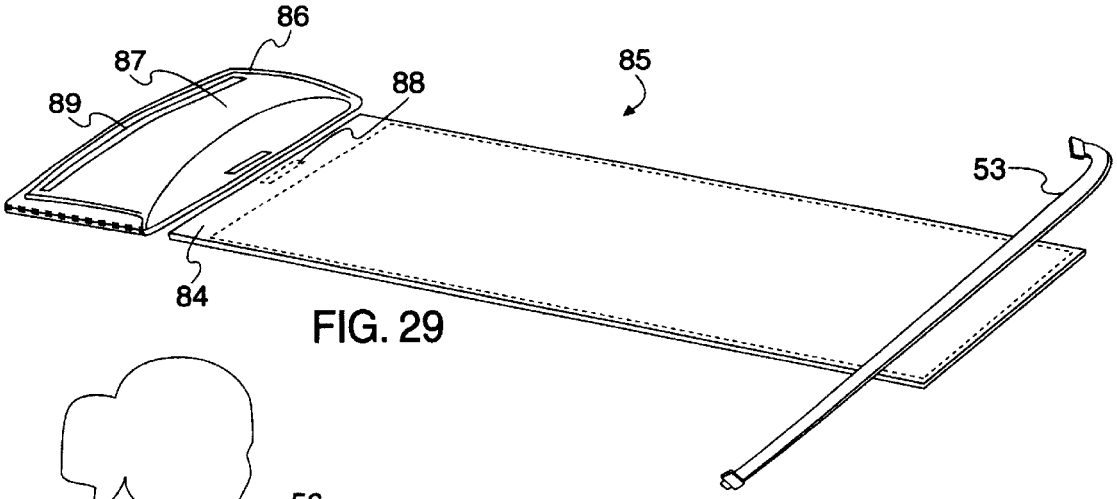
FIG. 29
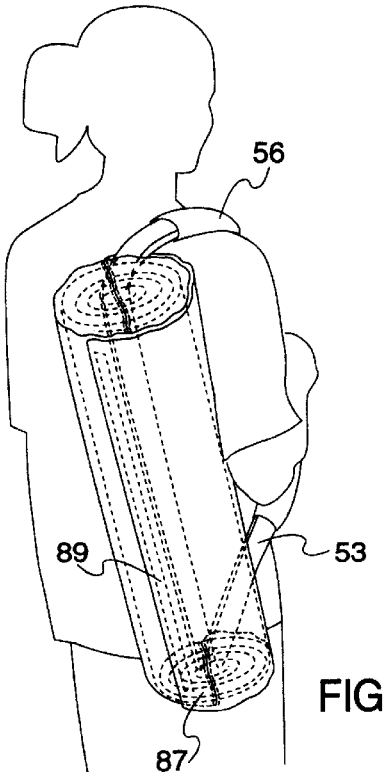
FIG. 31
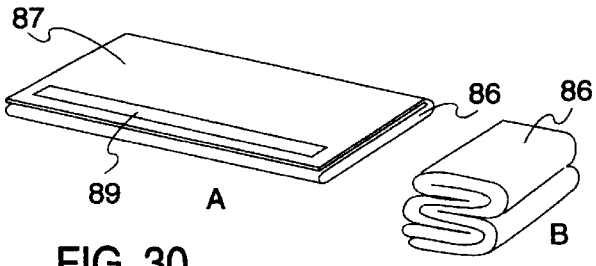
FIG. 30
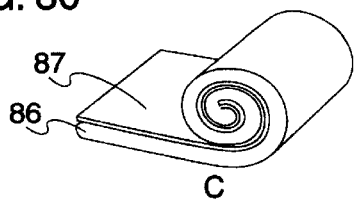

EXERCISE MAT ENSEMBLE AND METHOD OF USE

FIELD OF THE INVENTION

The instant invention relates to an exercise mat ensemble adapted for Yoga and other exercise disciplines and the method of use of same.

BACKGROUND OF THE INVENTION

Any activity that takes place on the ground or on the floor is made easier and more pleasant with the use of a mat or other padded surface. Early patents for such mats were designed for sleeping outdoors or for use at the beach. Later various sports required surfaces with different degrees of softness and a variety of athletic mats were developed. Yoga, having been practiced for many years by a limited following has only recently reached a broader segment of the population and has created a market for mats suited to the special requirements of this practice.

In U.S. Pat. No. 1,930,942, Pringle discloses a foldable combination of sheet and bag for use on the ground or on a deck chair. The sheet has side flaps that can be folded over the user for warmth. There is a cushion at one end of the sheet and a bag at the other. The sheet and cushion can be rolled or folded into the bag for carrying. A back rest can be used with the sheet and can be collapsed to fit into the bag which may also have a carrying strap attached. Another beach blanket assembly is taught by Glenn in U.S. Pat. No. 2,264,471. This one has a canvas bottom layer and a top layer of toweling. One end of the canvas is folded over and stitched to form one or more pockets which may be closed with zippers.

A foldable mat having a pad enclosed in fabric and a top cover layer, for use by a small child in a nursery school, is disclosed by Ybarra et al. in U.S. Pat. No. 3,774,249. A similar sleeping apparatus for use by adults is taught by Knobeloch in U.S. Pat. No. 4,601,076. This mat has a cover sheet that can be stored in a pocket at the foot end, and the mat can be rolled and tied for storage. See also U.S. Pat. No. 5,199,120 to Holmes; U.S. Pat. No. 5,720,057 to Duncan; and U.S. Pat. No. 6,141,805 to Fisher-Cohen et al. Carter et al. describes a padded mat with a pillow area and a built-in sound system for the ultimate in relaxation (U.S. Pat. No. 4,841,587). All of these products have padding between layers of fabric and in some systems a separate cover layer. They also have a separate carrying bag or the mat can be folded or rolled into an attached bag.

Swanger et al., in U.S. Pat. No. 6,065,164, teaches a fabric cover for a child's play mat. The cover is made of a washable fabric that is at least part cotton. The cover is in the form of an envelope with a Velcro® fastener at one end. A child's rest mat that consists of a foam pad enclosed in a removable fabric cover is disclosed by Alonso in U.S. Pat. No. 5,203,041. The cover is stitched around three sides and there is an extra flap of fabric at the open end which is folded over the pad to completely enclose it. Three sets of lines are stitched into the fabric to form fold lines so the mat can be folded in a uniform manner. Two handles on the underside provide easy carrying means. Scott discloses a similar washable cover for an exercise mat. (U.S. Pat. No. 5,099,530) The cover has one pocket for the insertion of a pillow and another pocket for a blanket.

A large mat for use by gymnasts and wrestlers is taught by Baldwin et al. in U.S. Pat. No. 4,137,583. A frame is made up of a number of segments so the size of the mat may be changed as needed. Cushioning pad segments are placed within the frame and a cover with elastic tie down devices all around is placed on top. The tie downs fit into notches in the frame to hold the cover taut. This mat system can be made large enough to cover most of a gym floor. Bramble, Jr. (U.S. Pat. No. 3,262,134) designed a mat for use by athletes such as high jumpers. A cover contains two thick foam cushions, each encased within a shield and forming a square mat. The shields have openings so that air can be let in and out to retain the resiliency of the foam. There are latex strips on the underside to prevent slippage on the floor.

A simple exercise mat made up of two sheets of fabric quilted together with a foam pad between them is disclosed by Westgor in U.S. Pat. No. 4,738,545. This mat has a double stitched channel around the entire periphery with a drawstring within the channel. When the exerciser is finished the gym clothes and shoes can be placed in the center of the mat and the drawstrings pulled causing the mat to be drawn into a carrying bag.

The prior art disclosed covers for mats that formed envelopes into which the mats had to be inserted. The insertion cannot be accomplished quickly and reversibly during the course of an exercise period. Other systems described secured mat covers which also cannot be quickly and easily removed and replaced.

Various mats for use by Yoga participants are available from matsmatsmats.com on the internet. This source reveals the standard vinyl sponge foam mat in several colors, kits with several components, and a tote bag as well as handled tote bags to contain the mats. Each item can be purchased separately. Yoga mats and tote bags are also available from other internet sources. Mats, yoga blocks, stretching straps and canvas tote bags may be purchased from many sporting goods shops. Some sets consisting of a tote bag and mat are also available.

None of the products currently on the market provide a mat with an absorbent cover. None provide a simple mat and a cover which enables the cover to be easily removed and replaced during the exercise session. None provide an enforced area for headstands and other positions, none provide a meditation blanket, nor do they offer roll-up capabilities that create a self-contained carry bag. There is a need for a flexible yoga mat ensemble that can accommodate all of needs of the variations of yoga exercises and positions as well as providing a meditation blanket while remaining compact and easy to transport.

BRIEF SUMMARY OF THE INVENTION

The present invention may provide an exercise mat ensemble that may be designed for the yoga practitioner, but that may be used for many other forms of exercise. A standard padded vinyl mat, often called the "sticky mat" may be provided, as well as a washable cover sheet. The cover sheet may be foldable to provide more cushioning for certain positions or it may have extra length that may be folded over to provide the cushioning for head stands, and seated, kneeling and shoulder positions. A strap that may be used for stretches may also be used as a carrying strap during transport. The cover sheet may rest on top of the sticky mat so that it may be removed and replaced quickly as needed. The same cover sheet may also be used as a meditation blanket. The cover sheet and strap may be available without the mat for persons already in possession of the sticky mat.

It is an object of the present invention to provide an ensemble that contains all of the elements needed for a full yoga regimen.

Another object of the present invention is to provide a sticky mat cover that is soft, absorbent and washable.

A further object of the present invention is to provide a mat cover that has excess length so that it can be folded over to form added support for certain exercises and positions.

A still further object of the present invention is to provide a strap that can be used for stretching and also as a carrying strap for transporting the ensemble.

Another object of the present invention is to provide an ensemble that contains materials that can be used for all of the varied yoga exercises and positions in one complete set.

A further object of the present invention is to provide a complete ensemble of yoga materials that can be quickly and compactly rolled into a single transportable unit.

Another object of the present invention is to provide a complete ensemble of yoga materials that is easy to set up, easy to change from one mode to another, and easy to pack into a single transportable unit.

An even further object of the present invention is to provide at least one component of the ensemble that may be used as a meditation blanket.

The present invention is an exercise mat ensemble for use by participants in exercise regimens that involve a variety of floor exercises. The ensemble comprises a padded rubberized rectangular mat having two longitudinal sides and two transverse sides, a proximal end and a distal end and a soft absorbent fabric cover of the same shape as the mat and being and at least one half inch longer than the mat on each of three sides. The fourth transverse side of the cover at the proximal end being substantially longer than one half inch. The cover completely conceals the mat on all four sides when placed on the mat. The ensemble may be used with the cover over the mat and the mat may be used alone, the cover being easily removed from the mat and just as easily replaced on the mat as needed to perform the exercises. The mat and cover, with the cover on top, may be rolled together from their distal ends for transport and storage and the longer end of the cover overlays the mat.

An exercise mat ensemble for use by participants in exercise regimens that involve a variety of floor exercises, where the ensemble comprises a padded rubberized rectangular mat having two longitudinal sides and two transverse sides, a proximal end and a distal end and a soft absorbent fabric cover of the same shape as the mat and being at least one half inch longer than the mat on each of the four sides so as to completely conceal the mat on all four sides when placed thereon. The ensemble may be used with the cover over the mat and the mat may be used alone. The cover is easily removed from the mat and just as easily replaced thereon as needed to perform the exercises, and the cover may be partially folded or rolled at one end to form a cushion for some of the exercises.

The mat and cover with cover on top may be rolled together from their distal ends so that the upper face of the cover is completely concealed within the roll and the roll may be transported and stored.

A method of performing a series of exercises and positions on a flat horizontal surface which comprises the steps of obtaining a padded rubberized rectangular mat having two longitudinal sides and two transverse sides, a proximal end and a distal end, obtaining a soft absorbent fabric cover of the same shape as the mat and being at least one half inch longer than the mat on each of the four sides so as to completely conceal the mat when placed thereon, placing the mat on the flat horizontal surface, performing exercises and positions upon the mat, placing the cover over the mat so that the mat is completely concealed thereunder, performing exercises and positions upon the cover, folding a portion of the cover back and upon itself to form a cushion, performing exercises and positions upon the cover utilizing the cushion, unfolding the folded portion of the cover and rolling a portion of the cover starting from one end to form a bolster, performing exercises and positions upon the cover utilizing the bolster, unrolling the bolster so that the cover completely conceals the mat thereunder, turning back the cover and reclining on the mat and bringing the cover over the body as a meditation blanket, rising and replacing the cover over the mat, rolling the cover and mat together from their distal ends until completely rolled and the upper surface of the cover is completely enclosed within the roll, transporting the cover and mat to a place of storage, and storing the cover and mat.

The present invention also incorporates an exercise mat cover ensemble for use with a padded rubberized rectangular mat having two longitudinal sides and two transverse sides. The ensemble and mat are for use by participants in exercise regimens that involve a variety of floor exercises. The ensemble comprises a soft absorbent fabric cover of the same shape as the mat and being at least one half inch longer than the mat on each of three sides and the fourth transverse side at the proximal end being substantially longer than one half inch. The cover completely conceals the mat on all four sides when placed thereon. The ensemble also incorporates a non-elastic strap that is substantially longer than twice the width of the cover. The cover may be used atop the mat and the mat may be used alone. The cover is easily removed from the mat and just as easily replaced thereon as needed to perform the exercises. The proximal end of the cover may be rolled or folded to provide additional cushioning for certain exercises. The strap may be used to assist in certain exercises and the cover may be placed on top of the mat with the strap placed across the distal transverse end of the cover as the cover and mat are rolled together from their distal ends so that the strap projects from both sides of the resulting roll, and the longer end of the cover overlaps the mat which is completely enclosed. The ends of the strap may be connected for ease of transport and storage.

Other features and advantages of the invention will be seen from the following description and drawings.

BRIEF DESCRIPTION OF THE DRAWINGS

FIG. 19 is a perspective view of the fourth alternate ensemble partially rolled;

FIGS. 20-A, B and C are perspective views of three ways to fold the extension of the fourth alternate ensemble;

FIG. 21 is a perspective view of the rolled fourth alternate ensemble with sheath;

FIG. 22 is a perspective view of the fifth alternate ensemble partially rolled;

FIGS. 23-A, B and C are perspective views of three ways to fold the extension of the fifth alternate ensemble;

FIG. 28 is a perspective view of the sixth alternate ensemble partially rolled;

FIG. 29 is a perspective view of the sixth alternate ensemble fully extended;

FIGS. 30-A, B and C are perspective views of three ways to fold the extension of the sixth alternate ensemble;

FIG. 31 is a perspective view of a person carrying the rolled sixth alternate ensemble;

DETAILED DESCRIPTION OF THE INVENTION

Figure 7:
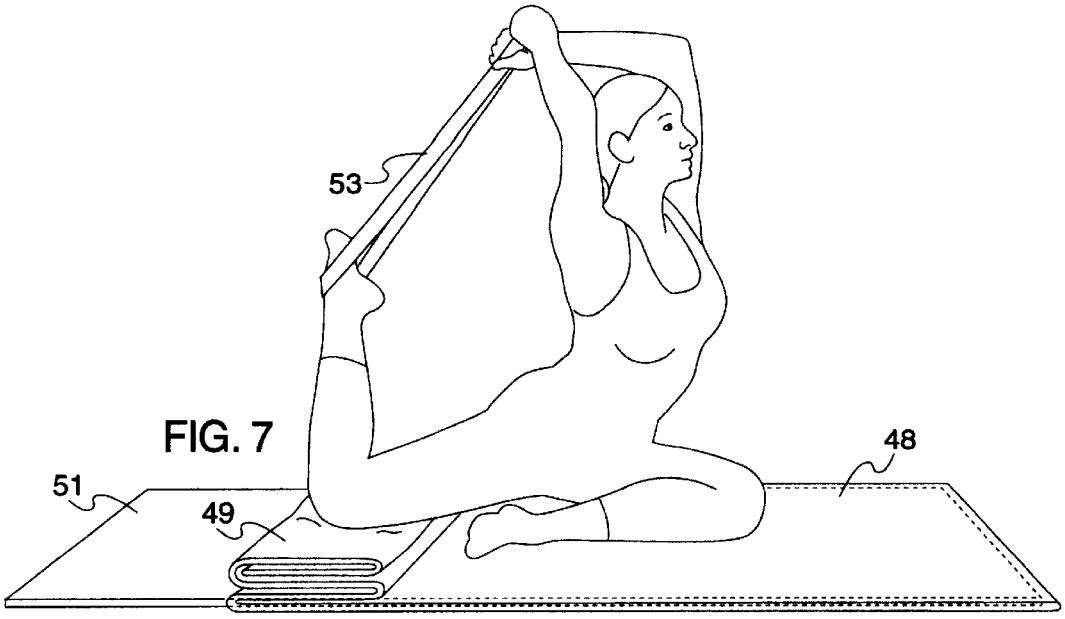
FIG. 7 is a perspective view of a user performing an exercise with the strap and utilizing a partially folded cover.

The practitioner of the exercise discipline known as yoga may usually perform the positions on a padded rubberized or vinyl rectangular mat that may typically be 6 feet (183 cm) long and 2 feet (61 cm) wide, though mats that are 5 feet (152 cm) long may also be used. Such mats may be referred to as "sticky mats" 51. The rubberized surface of the mat may prevent slippage on the floor, but the practitioner may become sweaty and find herself slipping on the upper surface of the mat. The present invention may provide a soft washable fabric cover 48 that may be dimensioned to completely overlay a sticky mat 51. The cover 48 may easily be placed on top of the sticky mat 51 when the absorbent surface is needed, and just as easily removed when the "sticky surface" is necessary to prevent slippage during certain exercises and positions. One end of the cover 48 may be folded to provide a cushion 49 to assist in certain positions as seen in FIG. 7.

The cover of the present invention may ideally be slightly larger than the sticky mat 51 with an overlap of at least 0.5 inch (1.27 cm) on all four sides. Thus the cover may be 73 in (185 cm) by 25 in (63.5 cm). This may be seen in FIGS. 24, 25 and 26. Different dimensions may be more suited to the positions of yoga, and a somewhat longer cover may provide extra fabric to completely surround the sticky mat when the mat and cover are rolled together for transport and storage. (FIG. 5) Variations of the present invention may require additional lengths of fabric. The present invention lends itself to a number of variations, all of which exhibit the intent and function of the invention, but each perform that intent and function in a slightly different manner.

Figures 1, 2, 3, 4, 5, 6:
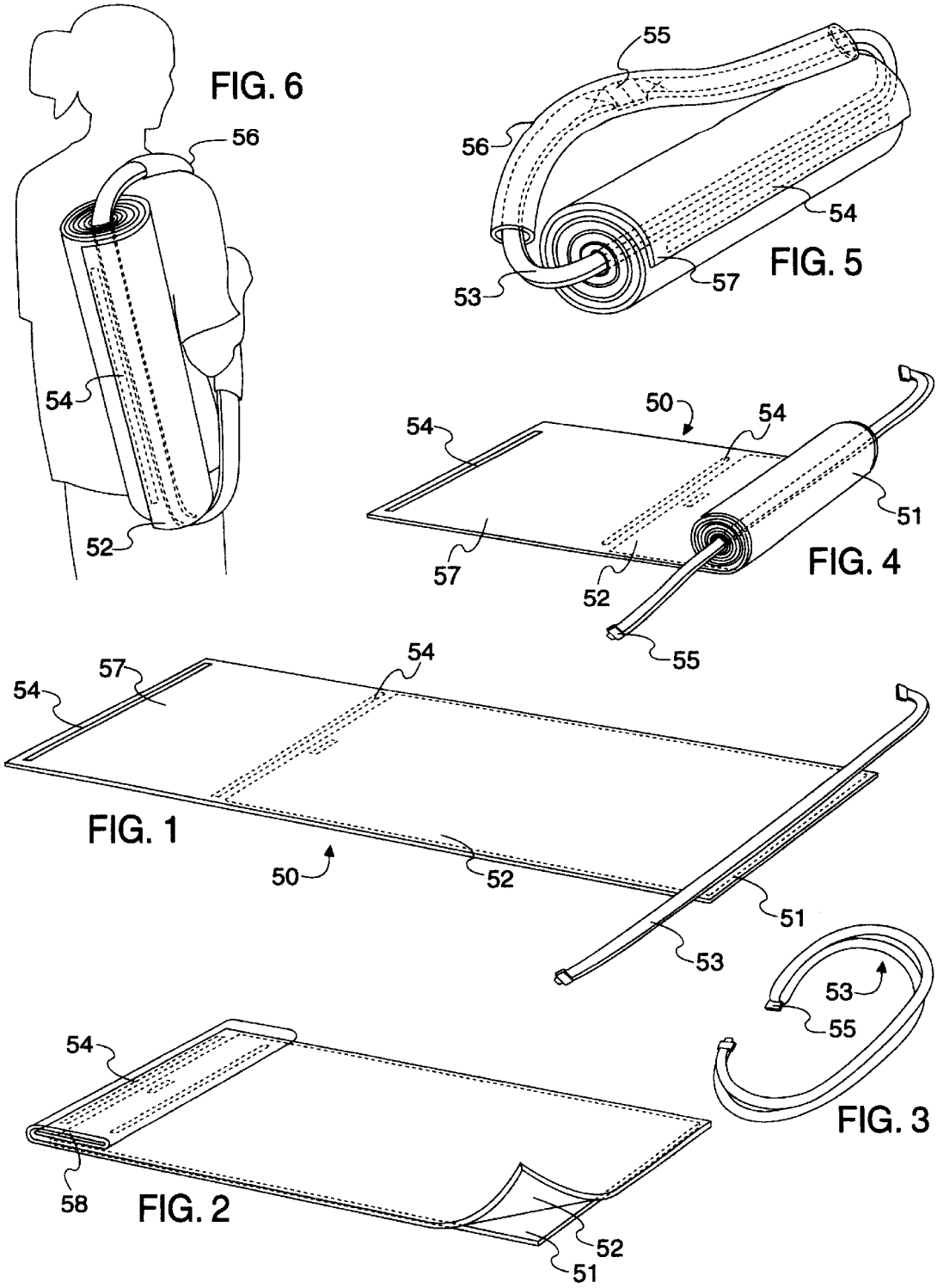
FIG. 1 is a perspective view of the fabric cover and mat spread out to full length.
FIG. 2 is a perspective view of the fabric cover and mat with the fabric extension folded to form a support.
FIG. 3 is a perspective view of one type of strap.
FIG. 4 is a perspective view of the cover and mat partially rolled around the strap.
FIG. 5 is a perspective view of the fully rolled ensemble with cushioned sheath over the strap.
FIG. 6 is a perspective view of a person carrying the rolled ensemble.
Figure 8:
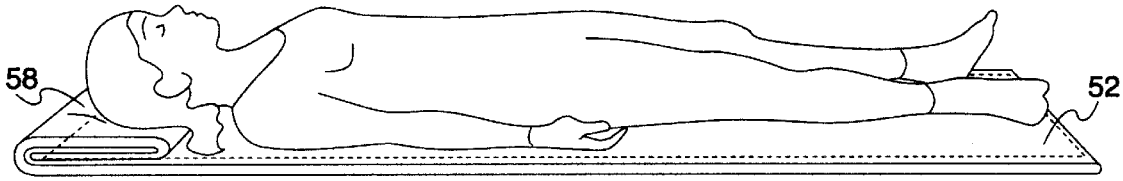
FIG. 8 is a perspective view of a user lying on the mat with cover and utilizing the folded extension.
Figure 9:
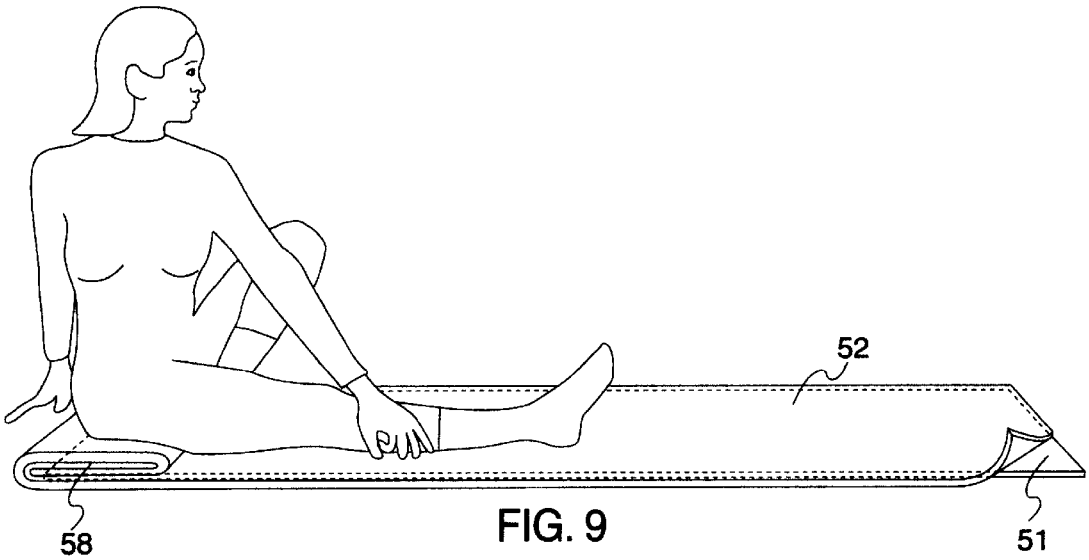
FIG. 9 is a perspective view of a user performing a seated position on the mat with cover and utilizing the folded extension.

An elongated cover 52, seen in FIG. 1, may be extended to a length of about 9 feet (274 cm) while maintaining the width at 25 inches (63.5 cm). When this cover 52 is in use, it may ideally be placed longitudinally over the sticky mat 51 so that one end of the cover 52 extends only 0.5 inch (1.27 cm) beyond the distal transverse edge of the sticky mat 51 and the other end of the cover extends about 3 feet (91 cm) beyond the proximal transverse edge of the sticky mat 51. The extra 3 feet (91 cm) of fabric, the extension 57, may be folded in two or more folds 58 to form a cushion that may be advantageous for several yoga positions. See FIGS. 2, 8 and 9. Often it may be necessary to cushion the hip or provide cushioning for the head, and the folded 58 fabric extension 57 may easily accommodate these needs. The extension 57 may be from 1 foot (30.5 cm) to 5 feet (152.4 cm) long, but 3 feet (91 cm) may be best to accommodate the various needs of the yoga regimen. A shorter length may have to be folded back over the mat 51 to provide the necessary amount of cushioning, and a longer length may provide too much bulk and actually decrease the efficiency of the extension 57.

Another element that may form a part of the ensemble 50 of the present invention may be a strap 53 (FIG. 3) that may serve two purposes. One use of the strap 53 may be to assist in many of the positions, one of which may be seen in FIG. 7. The second use may be as a carrying strap to assist in the transport of the ensemble 50. The strap 53 may be made up of one or two lengths of a strong but non-elastic material and may be made adjustable in length by any means known in the art. There may be a fastening means such as a buckle 55 assembly, with one portion of the buckle 55 assembly affixed to each end of the strap 53 so the strap 53 may be formed into a continuous loop. Other fastening means that will accomplish this may be utilized. To prepare the ensemble 50 for transport and storage, the sticky mat 51 may be placed flat on the floor and the cover 52 may be placed on top of the mat 51 in the same manner as during its use for exercise. The two components may then be rolled together. When the strap 53 is included in the ensemble 50, it may be placed along the distal transverse edge where the sticky mat 51 and cover 52 are almost even. (FIG. 1) The two layers may then be rolled up starting at the distal transverse edge and rolling toward the proximal edge(FIG. 4). By rolling the three components in this manner the sticky mat 51 is on the outside of the roll until the entire sticky mat 51 is rolled up, thereafter, the fabric extension 57 at the proximal end may be rolled over the sticky mat 51 and may completely surround it so that the entire sticky mat 51 may be covered by the fabric extension 57. The strap 53 may be in the middle of the roll with the ends projecting out of each side. See FIG. 5. The upper face of the cover 52 may always be contained within the roll and the ends of the strap 53 may be mated for ease of transport.

The ensemble may also include a sheath 56. The strap 53 may be threaded through the sheath 56 or the sheath may be placed around the strap 53 according to its construction. The sheath 56 may form a cushion over the strap 53 when the ensemble 50 is carried over the shoulder as seen in FIG. 6. The sheath 56 may also be used as cushioning for certain positions of the exercise regimen.

To maintain the ensemble 50 in the rolled configuration additional fastening means such as cooperating strips of hook and loop type fastener 54 may be added to the cover 52. One strip 54 may be placed on the obverse surface of the extension 57 adjacent the transverse edge, and the coacting strip 54 may be placed near the proximal end of the sticky mat 51 on the reverse surface of the extension 57. In this manner, when the cover 52 and mat 51 are properly rolled together the two strips 54 may mate and maintain the cover 52 so that the sticky mat 51 is completely covered and contained within the roll. Other fastening means known in the art may also be used to accomplish this purpose. This method of rolling the components may also keep the sticky mat 51 and the top surface of the cover 52 completely shielded so that they may remain clean during transport and storage. By rolling the components in this manner, the ensemble 50 forms its own carrying case with carrying strap.

Figure 10:
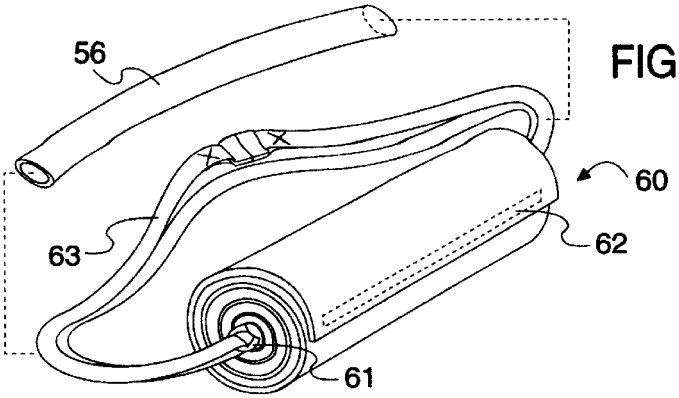
FIG. 10 is a perspective view of the fully rolled first alternate ensemble.
Figure 11:
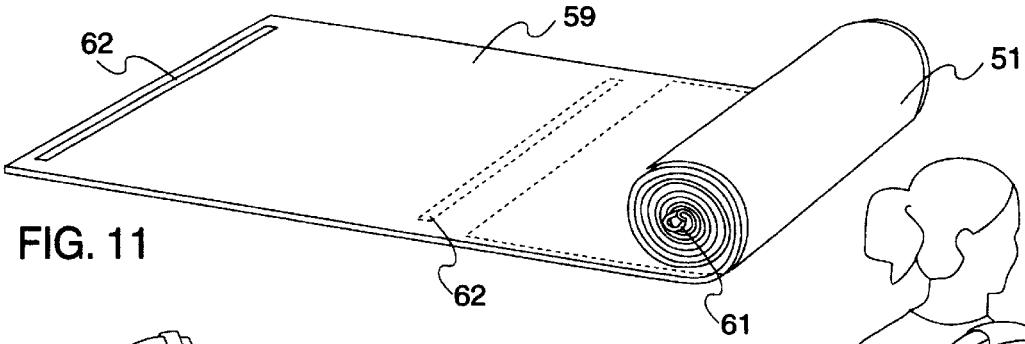
FIG. 11 is a perspective view of a partially rolled first alternate ensemble.
Figure 12:
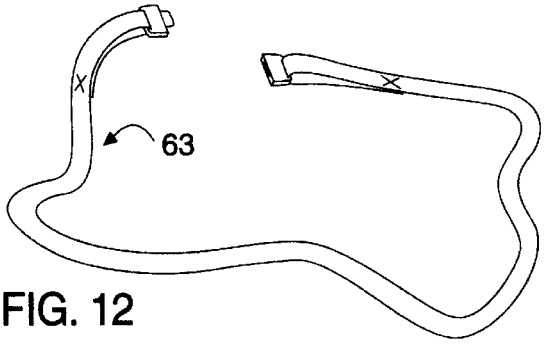
FIG. 12 is a perspective view of a second strap.

A first alternate ensemble 60 may have an attachment ring 61 affixed to each corner of the distal end of the cover 59 so that the rings 61 may be at the outside center when the ensemble 60 is rolled. This system may require a somewhat longer second strap 63 which is not contained within the roll. The strap 63 (FIG. 12) may be looped through both rings 61 such that the second strap 63 is completely outside of the rolled ensemble 60 (FIG. 10). There may be cooperating strips 62 of hook and loop type fastener on each side of the cover 59 to maintain closure after rolling. The cushioning sheath 56 may also be used with the second strap 63.

Figure 13:
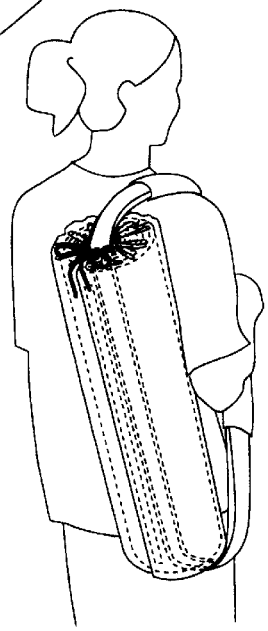
FIG. 13 is a perspective view of a person carrying a rolled second alternate ensemble.
Figure 14:
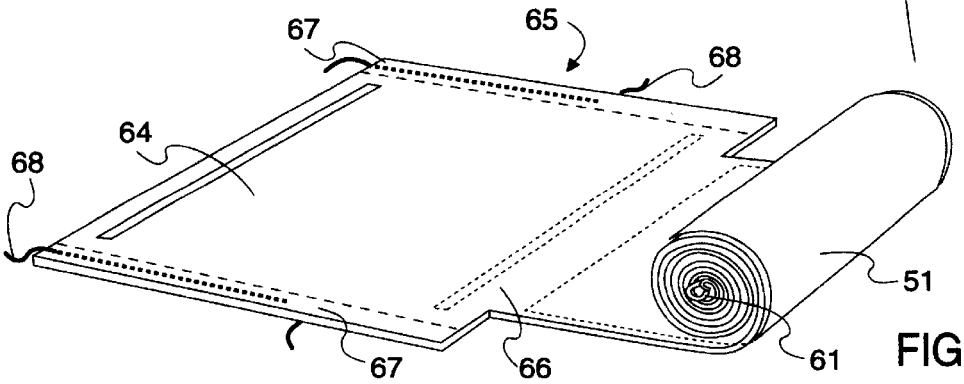
FIG. 14 is a perspective view of a partially rolled second alternative ensemble with attachment rings.
Figure 15:
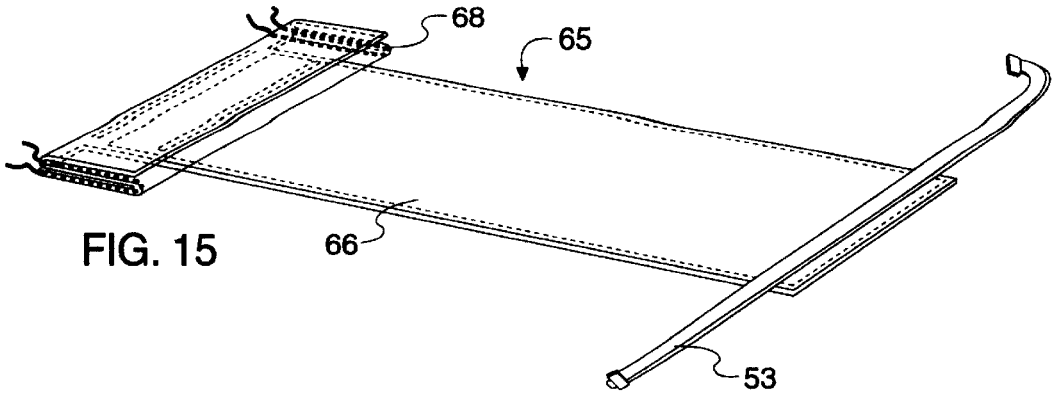
FIG. 15 is a perspective view of the second alternate ensemble with the extension in folded orientation.
Figure 16:
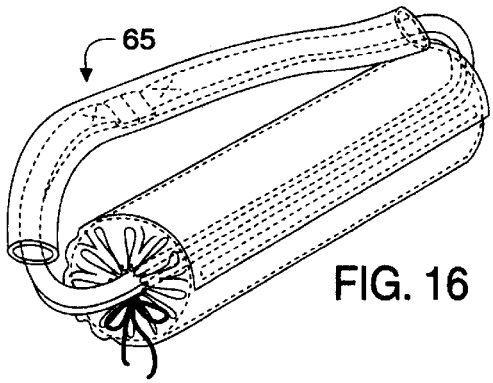
FIG. 16 is a perspective view of the fully rolled and enclosed second alternate ensemble with strap rolled within.

A second alternate ensemble 65 may have the extension 64 of the cover 66 made several inches wider on each side. There may be a folded and stitched channel 67 on each side edge through which is placed a drawstring 68 which may be seen in FIG. 14. When the second alternate ensemble 65 is rolled the drawstrings 68 may be pulled and tied to form further shields over each end of the roll. See FIG. 13. The second strap 63 and attachment rings 61 may be used with this alternate (FIG. 14) or the first strap 53 may be rolled inside the unit as seen in FIGS. 15 and 16. The end shields formed by pulling the drawstrings 68 closed may easily accommodate either strap form.

Figure 17:
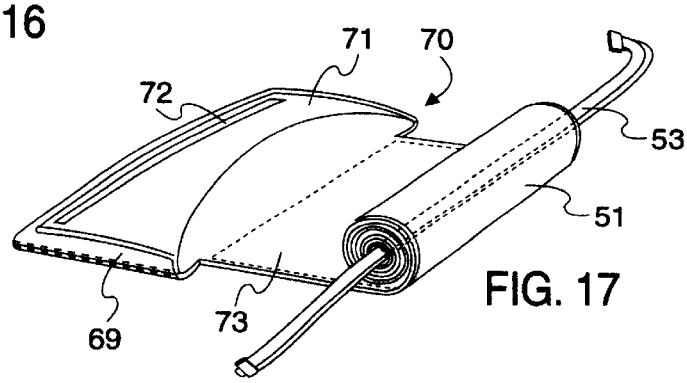
FIG. 17 is a perspective view of the partially rolled third alternate ensemble.
Figure 18:
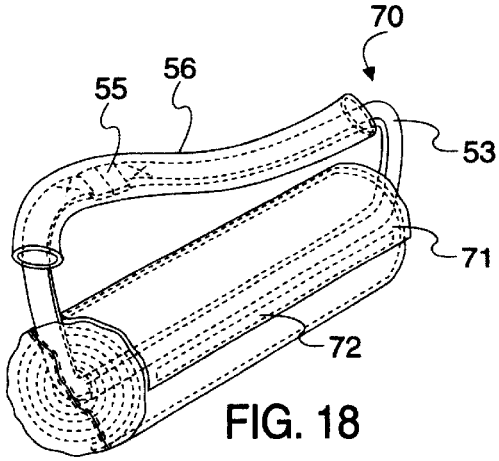
FIG. 18 is a perspective view of the fully rolled and enclosed third alternate ensemble.

A third alternate ensemble 70 may have the widened extension portion folded and stitched to form an envelope 69 and flap 71. (FIGS. 17 and 18) The extra two layers of the envelope 69 and the third layer of the flap 71 may be folded over the main portion of the cover 73 to provide the cushioning needed for the various positions. The rolled third alternate ensemble 70 may fit into the envelope 69 and the flap 71 may fold over to completely enclose the rolled cover 73 and mat 51. There may be closure means such as strips 72 of hook and loop type fastener, on the flap 71 and underside of the envelope 69 to maintain closure. A strap 53 may also be utilized.

The extension 57 of the cover 52 of the ensemble 50 (and 60, 65 and 70) may be utilized to provide extra cushioning for various positions and exercises. However, this cushioning may be limited by the very attachment of the extension 57 to the cover 52. A fourth alternate ensemble 75 may have the cover in two pieces, the main cover 74 and the extension 76, as seen in FIG. 19. The main cover 74 may extend over the sticky mat 51 at least 0.5 inch (1.27 cm) around three sides and may be slightly more, at least 2 in. (5 cm) at the proximal transverse end. The extension 76 may be a separate piece of the same washable fabric as the main cover 74. The extension 76 may be about 4 feet (122 cm) long and 25 in (63.5 cm) wide. There may be corresponding strips 77 of hook and loop type fastener or other fastening means along adjacent transverse edges (one on the obverse side and one on the reverse side) of the main cover 74 and the extension 76 so that they may be joined when necessary. There may be additional strips 78 of hook and loop type fastener on the obverse surface of the outer end of the extension 76 and the reverse surface of the inner end of the extension 76 to secure the cover when the ensemble 75 is rolled for transport and storage. See FIG. 21. Any other fastening means known in the art may be used.

Figure 24:
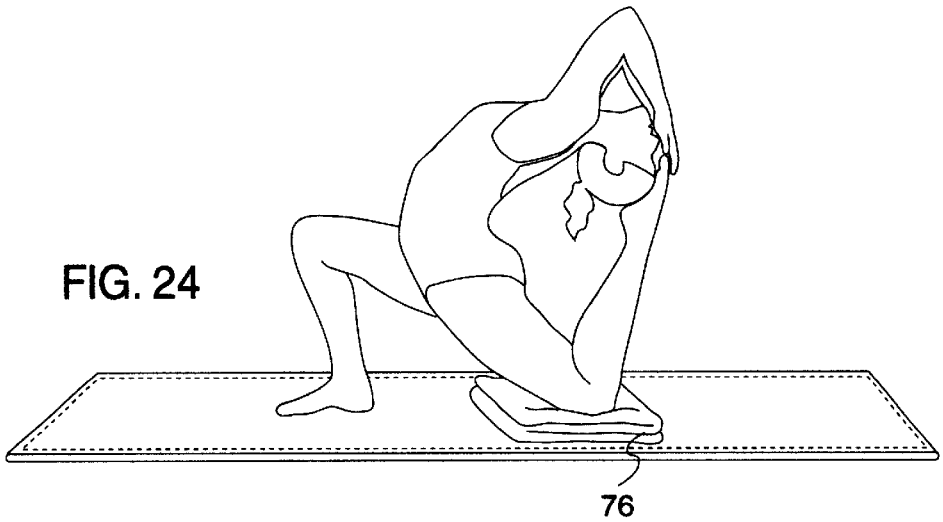
FIG. 24 is a perspective view of a person performing a position utilizing a folded extension.
Figure 27:
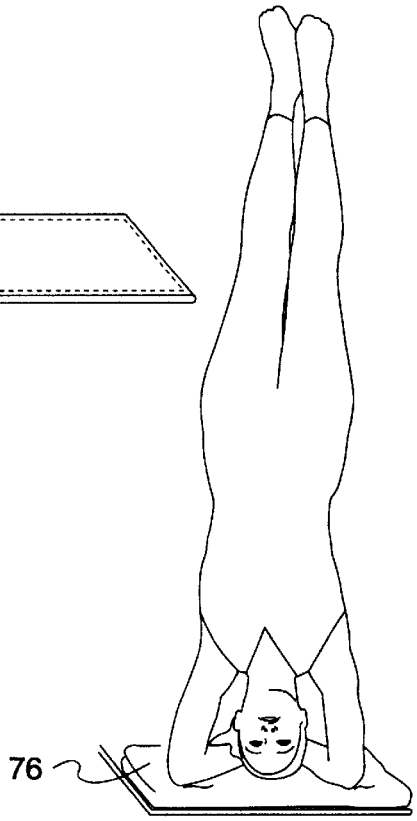
FIG. 27 is a perspective view of a person performing a position utilizing a folded extension.
Figure 25:
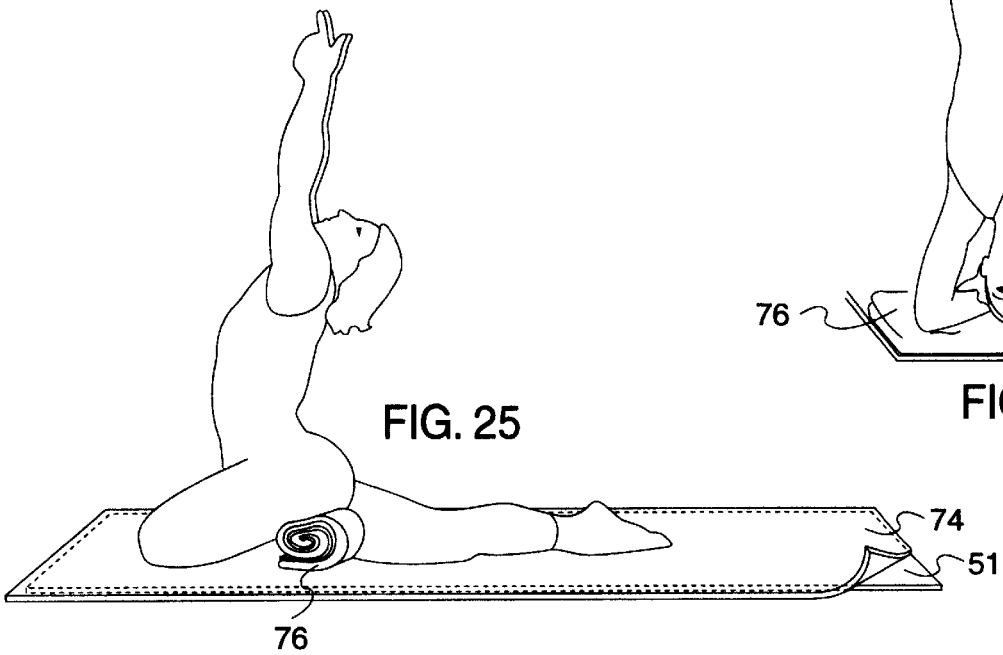
FIG. 25 is a perspective view of a person performing a position utilizing a folded and rolled extension.

The separate extension 76 may be folded in different ways. The extension 76 may be folded in thirds as seen in FIG. 20-A. This form may be useful for such positions as headstands (FIG. 27) or for stretches (FIG. 24). Further folding or rolling of the already folded extension 76 as seen in FIGS. 20-B and 20-C may be used for positions such as illustrated in FIG. 25. The extension 76 may also be used as a meditation blanket as may be seen in FIG. 26. Either strap (53 or 63) may be used.

A fifth alternate ensemble 80 may be seen in FIG. 22. In this form the cover is also in two pieces. The main cover 78, the same as in the fourth alternate 75, and the extension 79 which has stitched channels 81 on both longitudinal edges, with drawstrings 82 within the channels 81. There may be strips 83 of hook and loop type fastener along adjacent transverse edges to join extension 79 to the main cover 78. The drawstrings 82 may be pulled and tied when the ensemble 80 is rolled, in the same manner as the drawstrings 68 in the second alternate ensemble 65. The extension 79 of the fifth alternate ensemble 80 may also be folded in several ways as seen in FIG. 23 and may be utilized as noted above. A strap (53 or 63) may be included.

A sixth alternate ensemble 85 seen in FIGS. 28 and 29 may also have a two piece cover, the main cover 84 and an extension in the form of an envelope 86. The envelope may have a flap 87 that may be folded over the opening of the envelope 86 to completely enclose the mat 51 and main cover 84 when they are rolled and placed inside. There may be corresponding strips 88 of hook and loop type fastener disposed along adjacent edges to reversibly affix the envelope 86 to the cover 84. A strap 53 may complete this ensemble 85. The two fabric layers of the envelope 86 and the third layer of fabric that forms the flap 87 may be used as the needed extra cushioning for various positions. The envelope 86 and flap 87 may also be rolled and folded for specific cushioning needs. See FIGS. 30-A, B and C. Additional strips 89 of hook and loop type fastener, or other closure means, may be used to close the flap 87 when the ensemble 85 is carried or stored. (FIG. 31)

Figure 32:
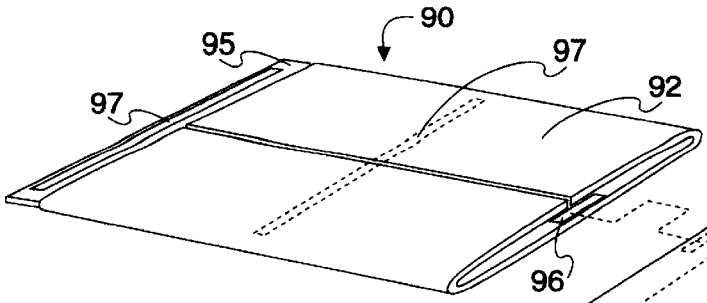
FIG. 32 is a perspective view of the seventh alternate ensemble partially rolled with the wings of the extension folded over the central portion.
Figure 33:
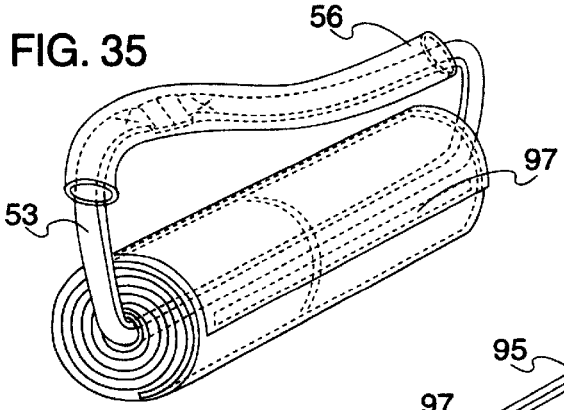
FIG. 33 is a perspective view of the extension of the seventh alternate ensemble completely spread out.
Figure 33:
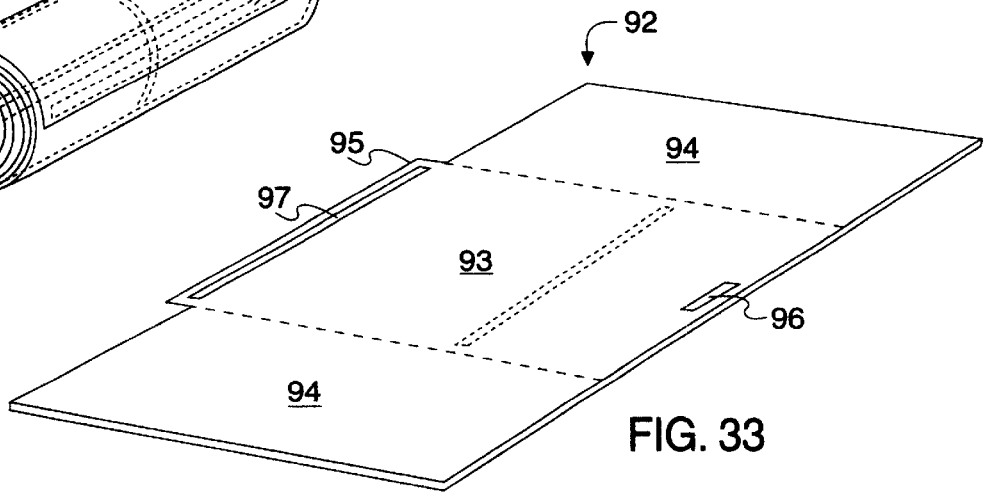

A seventh alternate ensemble 90 may also have two sections, a main cover 91 and an extension 92 seen in FIG. 32. The main cover 91 may be 0.5 inch (1.27 cm) larger than the sticky mat 51 on three sides, and may be at least 2 in (5 cm) longer than the sticky mat 51 at the proximal transverse end. The extension 92, seen completely spread out in FIG. 33, may be at least 3 ft (91 cm) long and 50 in (127 cm) wide. This width may correspond to a 25 in (63.5 cm) central portion 93 with two 12.5 in (31.75 cm) wings 94, one on each side. This may enable the extension 92 to be the same width as the main cover 91 when the two wings are folded over the central portion as shown in FIG. 32. The central portion 93 may also be two or three inches (5 cm or 7.6 cm) longer at the outer end. This additional length 95 may project beyond the folded wings 94 for the placement of a fastener means such as a strip 97 of hook and loop type fastener on the obverse side which may coact with a corresponding strip 97 of hook and loop type fastener disposed at substantially the center of the reverse side. These strips 97 may coact to maintain the ensemble in covered orientation when it is rolled for transport and storage. There may be two or more additional cooperating strips 96 of hook and loop type fastener, on the reverse surface of the proximal end of the main cover 91 adjacent to the extension and on the obverse surface of the cooperating edge of the extension 92, to connect the extension 92 to the main cover 91. A strap 53 may also be used with this alternate and other fastening means known in the art may be utilized.

Figure 26:
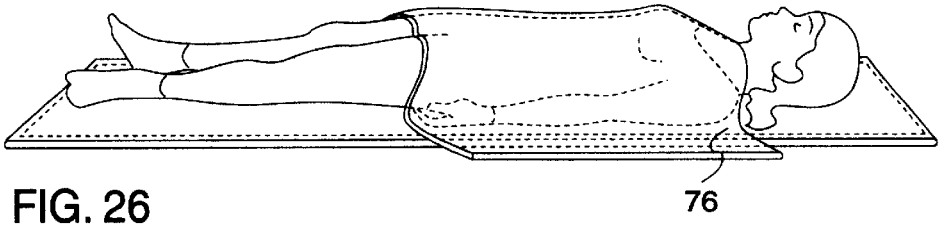
FIG. 26 is a perspective view of a person using an extension as a meditation blanket.
Figure 35:
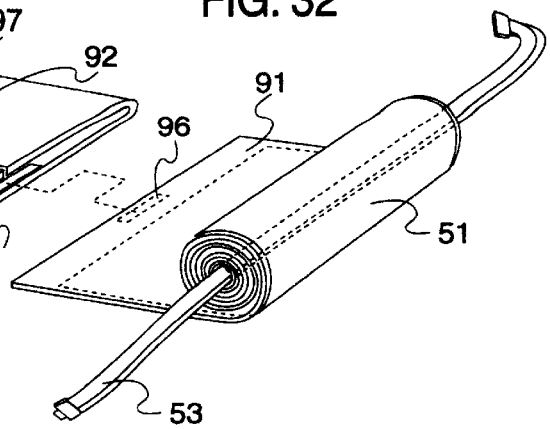
FIG. 35 is a perspective view of the rolled seventh alternate ensemble with the sheath in place.
Figure 34:
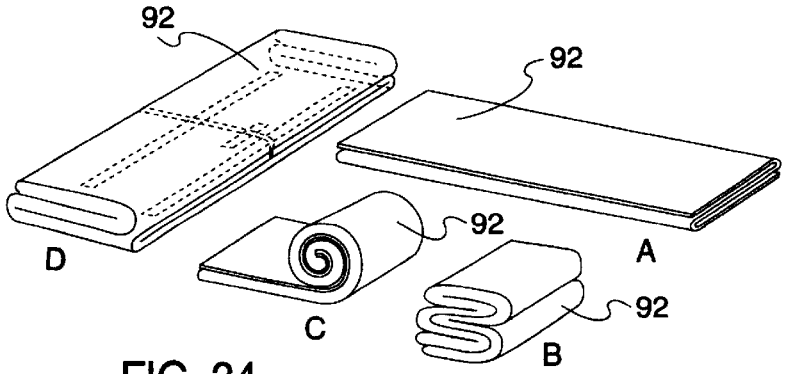
FIGS. 34-A, B, C and D are perspective views of four ways to fold the extension of the seventh alternate ensemble.

The extra wide extension 92 may be used for a meditation blanket similar to the one seen in FIG. 26, however, the extension 92 may cover most of the body of the user. The extra fabric may provide extra bulk, but it may also offer more folding variations, some of which may be seen in FIGS. 34-A, B, C and D. When the user wishes to roll the ensemble 90, the mat 51 may be placed flat on the floor and the main cover 91 placed over it. The extension 92, with wings 94 folded over the central portion 93 such that the wings 94 do not overlap each other, may be connected to the cover 91 by means of the fasteners 96. A strap 53 may be placed on the distal end of the cover 91 and the ensemble 90 rolled until the fasteners 97 of the extension 92 make contact to hold the unit in rolled orientation. The two ends of the strap 53 may then be connected. A sheath 56 may also be used to make carrying easier. The ensemble 90 ready for transport may be seen in FIG. 35.

In practice, the user may utilize the mat alone or the mat with the cover as needed during the selected routine of exercises and positions. The cover may easily be removed and placed off to one side and then placed back over the mat with little effort. The cover with attached extension or envelope, or the cover with separate extension or envelope, may be washed and dried as often as needed. The ensemble alternates may be made in various colors or color combinations and fabric variations. The covers may be formed from a single layer or sheet of fabric or from a padded or quilted fabric assembly. The fabric covers may be of solid colors, prints, plaids or any other patterns. The fabric used may also be water-proof or water resistant so that when completely rolled the interior of the ensemble may remain dry during inclement weather. The fastening means to maintain the extension as a cover over the rolled ensemble and to attach the extension to the main cover may also be hooks, snaps or any other form known in the art that will accomplish the connections. The extension may also be placed to overlap the cover without an attachment means. Strap closures may also be used to maintain the rolled orientation. The covers may also contain gym, organizational or personal identifying indicia. There may be pockets available on the extensions to hold personal items. Personal items or clothing may also be placed on the cover before rolling the ensemble so the items may be incorporated into the roll for transport. The various covers with one or the other strap assembly may be available without the mat which may be purchased separately.

While several embodiments of the present invention have been illustrated and described in detail, it is to be understood that this invention is not limited thereto and may be otherwise practiced within the scope of the following claims.

I claim:

1. An exercise mat ensemble for use by participants in exercise regimens that involve a variety of floor exercises, said ensemble comprising:

a padded rubberized rectangular mat having two longitudinal sides and two transverse sides, a proximal end and a distal end; and a soft absorbent fabric cover of the same shape as said mat and being at least one half inch longer than said mat on each of three sides and the fourth transverse side at the proximal end being substantially longer than one half inch, the mat being completely concealed on all four sides when the cover is placed thereon, whereby the ensemble may be used with the cover over the mat and the mat may be used alone, said cover being easily removed from the mat and just as easily replaced thereon as needed to perform the exercises, and the mat and cover with cover on top and distal ends aligned may be rolled together from their distal ends for transport and storage and the longer end of said cover overlaying said mat.

2. An exercise mat ensemble as in claim 1 further comprising a strap having two ends and being of sufficient length to be inserted within the rolled ensemble and extend beyond said roll whereby the two ends may be fastened together to assist in transporting said ensemble, and said strap to further assist in performing certain exercises.

3. An exercise mat ensemble as in claim 2 further comprising a sheath for placement around the strap to provide extra cushioning over said strap when transporting said ensemble.

4. An exercise mat ensemble as in claim 2 wherein the strap further comprises cooperating closure means affixed to each end thereof such that the strap may be formed into a loop for transporting said ensemble.

5. An exercise mat ensemble as in claim 1 wherein the cover is elongated at the proximal transverse end such that the elongated portion forms an extension of sufficient length that said extension may be folded to form a cushion over the proximal end of the mat for use in certain of the exercises and further so that the extension may be used as a flap to completely enclose the mat when the two components are rolled together from their distal ends.

6. An exercise mat ensemble as in claim 5 wherein the extension is from 1 to 5 feet in length.

7. An exercise mat ensemble as in claim 5 further comprising fastening means that consist of two cooperating elements, one element being disposed on the obverse side of the extension at the outer edge thereof and the other element being disposed on the reverse side of the extension adjacent to the mat when the cover is properly positioned, said fastening means for maintaining the extension as a flap over the mat when the cover5 and mat are rolled from their distal ends for transport and storage.

8. An exercise mat ensemble as in claim 5 wherein the extension is wider than the cover at each longitudinal side and further comprises a stitched channel along each of said sides and a drawstring disposed within each channel, whereby when the cover and mat are rolled from their distal ends the drawstrings may be drawn up and tied and the stitched channels form end covers for the rolled ensemble.

9. An exercise mat ensemble as in claim 1 further comprising an attachment ring affixed at each side of the distal end of the cover.

10. An exercise mat ensemble as in claim 9 further comprising a strap having two ends and being of sufficient length to be inserted through each of the attachment rings and extend beyond said attachment rings and around said rolled ensemble to assist in transporting said ensemble and said strap to further assist in performing certain exercises.

11. An exercise mat ensemble as in claim 10 wherein the strap further comprises cooperating closure means affixed to each end such that the strap may be formed into a loop for transporting said ensemble.

12. An exercise mat ensemble as in claim 10 further comprising a sheath for placement around the strap to provide extra cushioning over said strap when transporting said ensemble.

13. An exercise mat ensemble as in claim 1 wherein the cover is elongated at the proximal transverse end such that the elongated portion may be folded and stitched to form an envelope and a flap whereby the envelope and flap may be folded onto the cover to provide cushioning for selected exercises, the rolled cover and mat may be enclosed within the envelope and the flap may cover the opening for transport and storage.

14. An exercise mat ensemble as in claim 1 further comprising a second length of fabric of the same width as the cover and of sufficient length that said second length of fabric may be folded to form a cushion for use in some of the exercises and further so that the second length of fabric may be drawn over the participant for use as a meditation blanket.

15. An exercise mat ensemble as in claim 1 further comprising a second length of fabric of the same width as the cover and of sufficient length that said second length of fabric may be folded to form a cushion for use in some of the exercises and further so that the second length of fabric may be attached to the proximal end of the cover forming an extended cover and used as a flap to completely enclose the mat when the mat and extended cover are rolled together from their distal ends; and attachment means to attach said second length of fabric to said cover.

16. An exercise mat ensemble as in claim 1 further comprising:

a second length of fabric of sufficient length that said second length of fabric may be folded to form a cushion for use in certain of the exercises, said second length of fabric may be attached to the proximal end of the cover forming an extended cover and for use as a flap to completely enclose the mat when the mat and extended cover are rolled together from their distal ends, and said second length of fabric being wider than the cover, said extra width being sufficient such that each side may be folded over and stitched to form a channel;

a drawstring disposed in each channel; and attachment means to attach said second length of fabric to the proximal end of said cover, whereby when the mat and extended cover are rolled together from their distal ends the drawstrings are drawn up and tied and the stitched channels form end covers for the rolled ensemble.

17. An exercise mat ensemble as in claim 1 further comprising:

a second length of fabric of sufficient length that said second length of fabric may be folded to form an envelope and a flap, and said second length of fabric being of sufficient width to permit the sides of the envelope to be stitched for closure; and attachment means to attach said envelope to said cover such that the inside edge of the envelope is attached to the proximal edge of the cover;

whereby the envelope may be folded to provide cushioning for certain exercises and the cover and mat may be rolled from their distal ends and enclosed within the envelope with the flap closing over the rolled cover and mat to hold same therein for transport and storage.

18. An exercise mat ensemble as in claim 1 further comprising:

a second length of fabric of sufficient length to be folded to form a cushion for use in certain of the exercises, said second length of fabric being wider than the cover, said extra width being sufficient to form a central portion of the same width as the cover and two wing portions, one on each side of said central portion, each wing portion being substantially ½ the width of the central portion such that when folded over the central portion the two wings lie flat thereon with no overlap and further so that the second length of fabric with wings folded over the central portion may be attached to the proximal end of the cover forming an extended cover; and attachment means to attach said second length of fabric to said cover, whereby the second length of fabric may be used as a flap to completely cover the mat when the mat and extended cover are rolled together from their distal ends for transport and storage.

19. An exercise mat ensemble as in claim 1 wherein the fabric cover is washable.

20. An exercise mat ensemble as in claim 1 wherein the fabric cover is padded.

21. An exercise mat ensemble as in claim 1 wherein the fabric cover is water resistant.

22. An exercise mat ensemble for use by participants in exercise regimens that involve a variety of floor exercises, said ensemble comprising:

a padded rubberized rectangular mat having two longitudinal sides and two transverse sides, a proximal end and a distal end; and a soft absorbent fabric cover of the same shape as said mat and being at least one half inch longer than said mat on each of the four sides so as to completely conceal said mat on all four sides when placed thereon, whereby the ensemble may be used with the cover over the mat, the mat may be used alone, said cover being easily removed from the mat and just as easily replaced thereon as needed to perform the exercises, said cover may be folded or rolled at one end to form a cushion for certain of the exercises, the cover may be removed from the mat and placed over the participant as the participant lies on the mat for use as a meditation blanket, and the mat and cover with cover on top may be rolled together from their distal ends so that the upper face of the cover is completely concealed within the roll and the roll may be transported and stored.

23. A method of performing a series of exercises and positions on a flat horizontal surface, said method comprising;

obtaining a padded rubberized rectangular mat having two longitudinal sides and two transverse sides, a proximal end and a distal end;

obtaining a soft absorbent fabric cover of the same shape as said mat and being at least one half inch longer than said mat on each of the four sides so as to completely conceal said mat when placed thereon;

placing the mat on the flat horizontal surface;

performing exercises and positions upon said mat;

placing the cover over the mat so that the mat is completely concealed thereunder;

performing exercises and positions upon said cover;

folding a portion of the cover back and upon itself to form a cushion at the proximal end;

performing exercises and positions upon said cover utilizing said cushion;

unfolding the folded portion of the cover and rolling a portion of the cover from the proximal end to form a bolster;

performing exercises and positions upon said cover utilizing said bolster;

unrolling said bolster so that the cover completely conceals the mat thereunder;

turning back the cover, reclining on the mat and bringing the cover over a body such that the cover is used as a meditation blanket;

rising and replacing the cover over the mat;

rolling the cover and mat together from their distal ends until completely rolled and the upper surface of the cover is completely enclosed within the roll;

transporting the cover and mat to a place of storage; and storing the cover and mat.

24. A method of performing a series of exercises and positions as in claim 23 further comprising the steps of;

obtaining a strap composed of a non-elastic material, having two ends, and being of a length substantially greater than twice the width of the cover;

utilizing the strap in a selection of the exercises and positions;

placing the strap across the distal end of the cover after the cover has been placed atop the mat such that the mat is completely concealed thereunder and the strap extends beyond the cover on both sides;

rolling the cover and mat together from their distal ends until completely rolled together and the upper surface of the cover is completely enclosed within the roll and the strap extends on both sides from the center of the roll;

connecting the ends of the strap to form the strap into a loop;

transporting the rolled cover and mat, by holding the strap, to a place of storage; and storing the cover, mat and strap.

25. An exercise mat cover ensemble for use with a padded rubberized rectangular mat having two longitudinal sides and two transverse sides, said ensemble and mat for use by participants in exercise regimens that involve a variety of floor exercises and said ensemble comprising:

a soft absorbent fabric cover of the same shape as the mat and being at least one half inch longer than said mat on each of three sides and being substantially longer than one half inch on the fourth proximal transverse side, said cover to completely conceal the mat on all four sides when placed thereon, and a non-elastic strap having two ends and being substantially longer than twice the width of the cover;

whereby the cover may be used atop the mat and the mat may be used alone, said cover being easily removed from the mat and just as easily replaced thereon as needed to perform the exercises, the proximal end of the cover may be rolled or folded to provide additional cushioning for certain of the exercises, the strap may be used to assist in certain of the exercises, and the cover may be placed on top of the mat so that the mat is completely concealed thereunder with the strap placed across the distal transverse end of the cover and the cover and mat may be rolled together from the distal ends so that the strap projects from both sides of the resulting roll, the longer end of said cover overlaying the mat so that the mat is completely enclosed, and the ends of the strap may be connected for ease of transport and storage.

26. An exercise mat cover ensemble as in claim 25 further comprising a sheath for placement around the strap to provide extra cushioning over said strap when transporting said ensemble and mat.

27. An exercise mat cover ensemble as in claim 25 wherein the strap further comprises cooperating closure means affixed to each end thereof to connect the ends such that the strap may be formed into a loop for carrying said ensemble and mat.

28. An exercise mat cover ensemble as in claim 25 wherein the cover is elongated at the proximal transverse end such that the elongated portion forms an extension of sufficient length that when the cover is placed atop the mat and their distal ends are coextensive said extension may be folded to form a cushion for use in certain of the exercises and further so that the extension may be used as a flap to completely enclose the mat when the mat and cover are rolled together from their distal ends for transport and storage.

29. An exercise mat cover ensemble as in claim 28 further comprising fastening means that consist of two cooperating elements, one element being disposed on the obverse side of the extension at the outer edge thereof and the other element being disposed on the reverse side of the extension adjacent to the mat when the cover is properly positioned, said fastening means for maintaining the extension as a flap over the mat when the cover and mat are rolled together from their distal ends for transport and storage.

30. An exercise mat cover ensemble as in claim 25 wherein the extension is wider than the cover at each longitudinal side and further comprises a stitched channel along each of said sides and a drawstring disposed within each channel, whereby when the cover and mat are rolled together from their distal ends the drawstrings may be drawn up and tied and the stitched channels form end covers for the rolled mat and cover.

31. An exercise mat cover ensemble as in claim 25 further comprising a fastening ring affixed at each side of the distal end of the cover.

32. An exercise mat cover ensemble as in claim 31 wherein the strap is of sufficient length to be inserted through each of the fastening rings and extend beyond said fastening rings and around said rolled mat and cover to assist in transporting said rolled mat and cover.

33. An exercise mat cover ensemble as in claim 32 wherein the strap further comprises cooperating closure means affixed to each end thereof such that the strap may be formed into a loop when carrying said rolled mat and cover.

34. An exercise mat cover ensemble as in claim 32 further comprising a sheath for placement around said strap to provide extra cushioning over said strap when transporting the rolled mat and cover.

35. An exercise mat cover ensemble as in claim 25 wherein the cover is elongated at the proximal transverse end such that the elongated portion forms an envelope and a flap, whereby the envelope may be folded to provide cushioning for certain exercises and the cover and mat may be rolled from their distal ends and enclosed within the envelope with the flap closing over the rolled cover and mat to hold same within for transport and storage.

36. An exercise mat cover ensemble as in claim 25 further comprising a second length of fabric of the same width as the cover and of sufficient length that said second length of fabric may be folded to form a cushion for use in certain of the exercises and further so that the second length of fabric may be attached to the proximal end of the cover forming an extended cover and used as a flap to completely enclose the mat when the mat and extended cover are rolled together from their distal ends; and attachment means to attach said second length of fabric to said cover.

37. An exercise mat ensemble as in claim 25 further comprising a second length of fabric of sufficient length that said second length of fabric may be folded to form a cushion for use in certain of the exercises and of sufficient width that each side may be folded over and stitched to form a channel; a drawstring disposed in each channel; and fastening means to attach said second length of fabric to the proximal end of said cover, whereby the second length of fabric may be attached to the proximal end of the cover forming an extended cover and may be used as a flap to completely enclose the mat when the mat and extended cover are rolled together from their distal ends and when the mat and extended cover are rolled together the drawstrings may be drawn up and tied and the stitched channels form end covers for the rolled mat and cover.

38. An exercise mat cover ensemble as in claim 25 further comprising:

a second length of fabric of sufficient length that said second length of fabric may be folded to form an envelope and a flap, and said second length of fabric being of sufficient width to permit the sides of the envelope to be stitched for closure; and attachment means to attach said envelope to said cover such that the inside edge of the envelope is attached to the proximal edge of the cover;

whereby the envelope may be folded to provide cushioning for certain exercises and the cover and mat may be rolled from their distal ends and enclosed within the envelope with the flap closing over the rolled cover and mat to hold same within for transport and storage.

39. An exercise mat cover ensemble as in claim 25 further comprising a second length of fabric that is wider than the cover, said extra width being sufficient to form a central portion of the same width as the cover and two wing portions, one on each side of said central portion, and each wing portion being substantially ½ the width of the central portion so that when folded over the central portion they lie flat thereon with no overlap, and said second length of fabric being of sufficient length that said second length of fabric may be folded to form a cushion for use in certain of the exercises and further so that the second length of fabric with wings folded over the central portion may be attached to the proximal end of the cover forming an extended cover and may be used as a flap to completely cover the mat when the mat and extended cover are rolled together from their distal ends; and fastening means to attach said second length of fabric to said cover.

40. An exercise mat cover ensemble as in claim 25 wherein the fabric cover is washable.

41. An exercise mat cover ensemble as in claim 25 wherein the fabric cover is padded.

42. An exercise mat cover ensemble as in claim 25 wherein the fabric cover is water resistant.

* * * * *